United States Patent [19]

Eckert

[11] Patent Number: 4,718,561

[45] Date of Patent: Jan. 12, 1988

[54] EYEGLASS FRAME DISPLAY

[75] Inventor: Ronald P. Eckert, Prospect Heights, Ill.

[73] Assignee: Thomas A. Schutz Co., Inc., Morton Grove, Ill.

[21] Appl. No.: 847,687

[22] Filed: Apr. 3, 1986

[51] Int. Cl.[4] ..... A47F 7/00

[52] U.S. Cl. ..... 211/13; 211/194; 248/DIG. 2

[58] Field of Search ..... 211/13, 163, 189, 169, 211/194; 248/DIG. 2; 16/260, 266, 269; 160/135, 235; 220/4 F, 4 B, 4 D, 23.4; 206/5, 6; 403/331

[56] References Cited

U.S. PATENT DOCUMENTS

| | | | |
|---|---|---|---|
| 1,393,050 | 10/1921 | Talley et al. . | |
| 2,834,072 | 5/1958 | Miller | 160/235 X |
| 2,866,997 | 1/1959 | Eskridge et al. | 160/235 |
| 3,070,234 | 12/1962 | Deitchman . | |
| 3,513,606 | 5/1970 | Jones . | |
| 3,756,521 | 9/1973 | Wilkins . | |
| 3,884,356 | 5/1975 | Bloch . | |
| 3,895,718 | 7/1975 | Seiller | 248/DIG. 2 X |
| 3,931,894 | 1/1976 | Murphy . | |
| 4,126,366 | 11/1978 | Handler et al. . | |
| 4,157,760 | 6/1979 | Wilson . | |
| 4,262,800 | 4/1981 | Nethercutt | 211/13 X |
| 4,323,163 | 4/1982 | Johns . | |
| 4,576,320 | 3/1986 | Mead | 248/DIG. 2 X |
| 4,586,619 | 5/1986 | Eckert | 211/13 X |

*Primary Examiner*—Ramon S. Britts
*Assistant Examiner*—Blair M. Johnson
*Attorney, Agent, or Firm*—Wood, Dalton, Phillips, Mason & Rowe

[57] ABSTRACT

A display assembly for eyeglass frames, each having a bridge and spaced temples. A plurality of upright modules are arranged edge-to-edge to define a multi-sided geometrical configuration. Each module includes a forwardly projecting mid-portion defining a vertical front face. A plurality of upwardly opening hooks, having downwardly opening hook portions, project forwardly of the front face and each serve as a cradle for the bridge of an eyeglass frame. Horizontally spaced, generally planar side portions extend rearwardly of the vertical front face, and vertically extending convex edge portions are formed at the rear of the side portions. Spaced apertures are provided at the base of each convex edge portion through which the temples of the eyeglass frames can be extended, with the convex configurations of the edge portions serving to guide the temples into the apertures. Adjacent edges of adjacent upright modules are connected by male-female hinge sections which include stops to limit pivoting movement of adjacent modules in opposite directions.

10 Claims, 4 Drawing Figures

EYEGLASS FRAME DISPLAY

FIELD OF THE INVENTION

This invention relates to display stands and, particularly, to a modular display stand for eyeglass frames.

BACKGROUND OF THE INVENTION

Typically, display stands for eyeglass frames are constructed as a unit with either a single, flat display surface or several integral surfaces in an upright multi-sided geometrical configuration. Flat displays have disadvantages in that they generally poorly utilize space and afford a limited frontal display area. Alternatively, a multi-sided display, besides requiring somewhat intricate manufacturing and handling as a unit, takes up a great deal of space in storage and will accept only a fixed number of eyeglass frames. In the event that the unit is filled to capacity, an entire additional unit must be employed should one desire to display even a small number of additional frames.

An improvement in fixed displays of the character described is shown in U.S. Pat. No. 3,931,894 to Murphy. This patent shows a plurality of identical modules which are arranged edge-to-edge and snap-fit through mating male and female hinge portions at adjacent edges. There are several drawbacks to the Murphy structure. First of all, the modules that are snap-fit are likely to separate as easily as they were assembled. Separation at one hinge destroys the integrity of the remainder of the structure.

Further, when the modules are stacked vertically the strength of the overall structure is compromised. For example, the cubicle sections formed by sets of four modules might tend to separate, each from the other. In addition, it is difficult to maintain the alignment of the elements when vertically stacked. Any irregularity in the lower stacked modules will reflect itself in the upper modules. These and other problems associated with such modular display stands as the Murphy construction are addressed in copending application Ser. No. 492,795, filed May 9, 1983, and assigned to the assignee of this invention now U.S. Pat. No. 4,586,619.

This invention is directed to further improvements in display stands for eyeglass frames similar to that shown in application Ser. No. 492,795. Specifically, the display of this invention has a unique curved profile including novel means for guiding the eyeglass frame temples into position on the frame, means for retaining the bridge of the frames on the display, and means for preventing excessive pivoting of the module sections, all unitarily molded in an integral structure.

SUMMARY OF THE INVENTION

An object, therefore, of the invention is to provide an improved modular display for eyeglass frames of the character described.

In the exemplary embodiment of the invention, a display assembly is provided for eyeglass frames, each having a bridge and spaced temples. The assembly includes a plurality of modules arranged edge-to-edge to define a multi-sided upright geometrical configuration.

Each upright module includes a forwardly projecting mid-portion defining a vertical front face. A plurality of vertically spaced support means project forwardly of the front face and each serve as a cradle for the bridge of an eyeglass frame. Horizontally spaced, diverging side portions extend rearwardly of the vertical front face. Vertically extending concave edge portions are located at the rear of the side portions. Spaced apertures are formed at the base of each concave edge portion through which the temples can be extended, with the concave configurations of the edge portions serving to guide the temples into the apertures.

The vertically spaced support means are disclosed in the form of upwardly opening hooks for cradling the bridges of the eyeglass frames. Another feature of the invention is the provision of a downwardly opening hook portion on each upwardly opening hook for receiving retaining means, such as an elastic band, to hold an eyeglass frame on the hook.

A further feature of the invention is the provision of stop means formed integral with complementary, opposed male and female hinge means along the edges of adjacent modules to limit pivoting movement of the modules in opposite directions.

Each upright module is molded as a unitary structure of plastic or like material. The front face of each module is convex in configuration and merges smoothly into the side portions of the module. The side portions are generally planar and merge smoothly into the concave edge portions.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
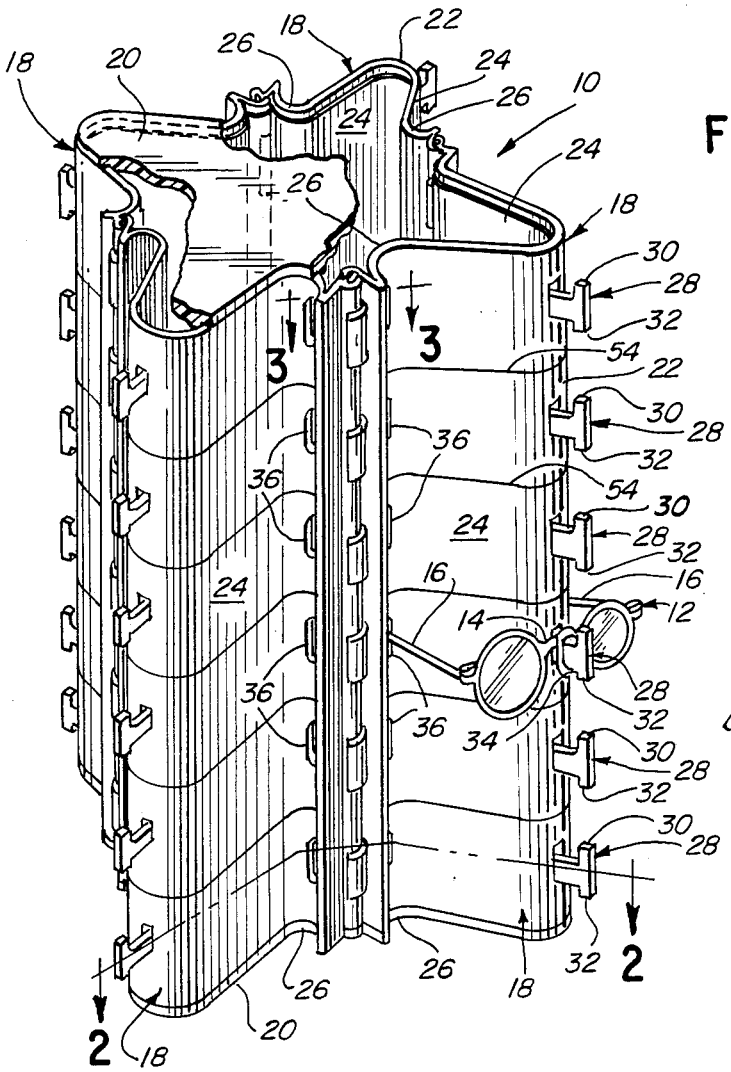
FIG. 1 is a perspective view of a modular display assembly incorporating the concepts of the invention.

Referring to the drawings in greater detail, and first to FIG. 1, a modular display assembly incorporating the concepts of the invention is shown and generally designated 10. The assembly is for supporting and displaying eyeglass frames, generally designated 12, each frame including a bridge 14 and spaced temples 16. The eyeglass frames are displayed about the periphery of assembly 10 in vertical columns defined by a plurality of upright modules, generally designated 18, hinged together and arranged edge-to-edge to define a multi-sided geometrical configuration as shown. Appropriate caps 20 are provided to close opposite ends of the geometrical configuration defined by display assembly 10.

Figure 2:
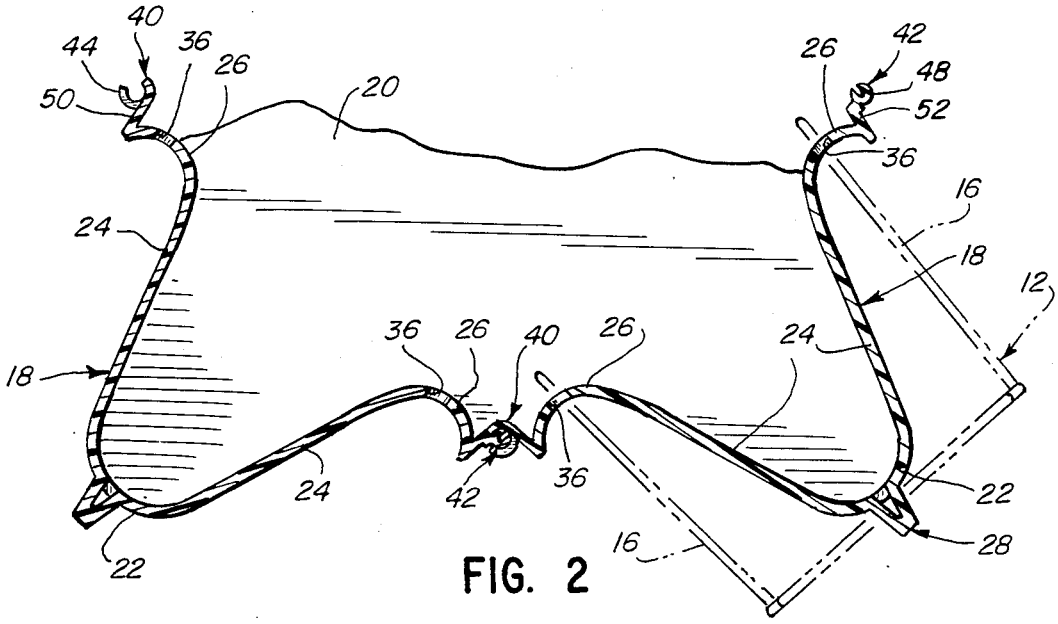
FIG. 2 is a horizontal section, on an enlarged scale, through two of the upright modules and taken generally along line 2—2 of FIG. 1.

Referring to FIG. 2 in conjunction with FIG. 1, each upright module 18 includes a forwardly projecting mid-portion defining a vertical front face 22. The front face is convex in configuration and merges smoothly into generally planar, horizontally spaced side portions 24 extending rearwardly of vertical front face 22 in a diverging manner. The rearwardly extending side portions 24 merge smoothly into generally concave edge portions 26 extending vertically along opposite edges of each upright module 18 and curved forwardly in hooked configuration to prevent the temples from sliding past the edges. This neat curved configuration is afforded by preferably fabricating each upright module 18 as a unitary molded structure, such as of plastic or like material.

A plurality of vertically spaced support means, generally designated 28, project forwardly of the front face 22 of each upright module 18, each support means serving as a cradle for bridge portion 14 of eyeglass frame 12. More particularly, each support means 28 is formed by an upwardly opening hook 30 for cradling the bridge of the eyeglass frame therebehind to support the eyeglass frame and prevent the frame from moving forwardly of the display assembly. Each support means 28 further includes a downwardly opening hook portion 32 for receiving retaining means to hold the eyeglass frame on the hook. The retaining means may take the form of an elastic band 34 (FIG. 1) for wrapping around bridge portion 14 of the eyeglass frame and behind downwardly opening hook portion 32.

Vertically spaced apertures 36 are formed through the base or bottom of each concave edge portion 26 of each upright module 18 through which temples 16 of eyeglass frame 12 can be extended. Therefore, it can be seen that the concave configurations of the edge portions serve to guide the temples into the apertures. This is a vast improvement over prior modules wherein the temples could slide past the edges of the upright modules or could become entangled in the hinged areas of adjacent modules.

Figure 3:
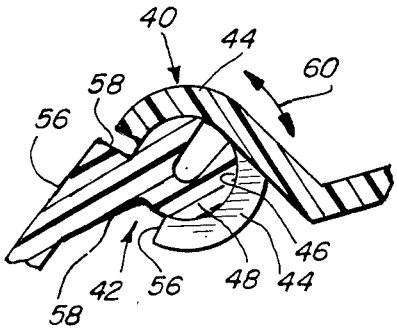
FIG. 3 is a fragmented horizontal section, on a further enlarged scale, through the hinge means between adjacent modules and taken generally along line 3—3 of FIG. 1.
Figure 4:
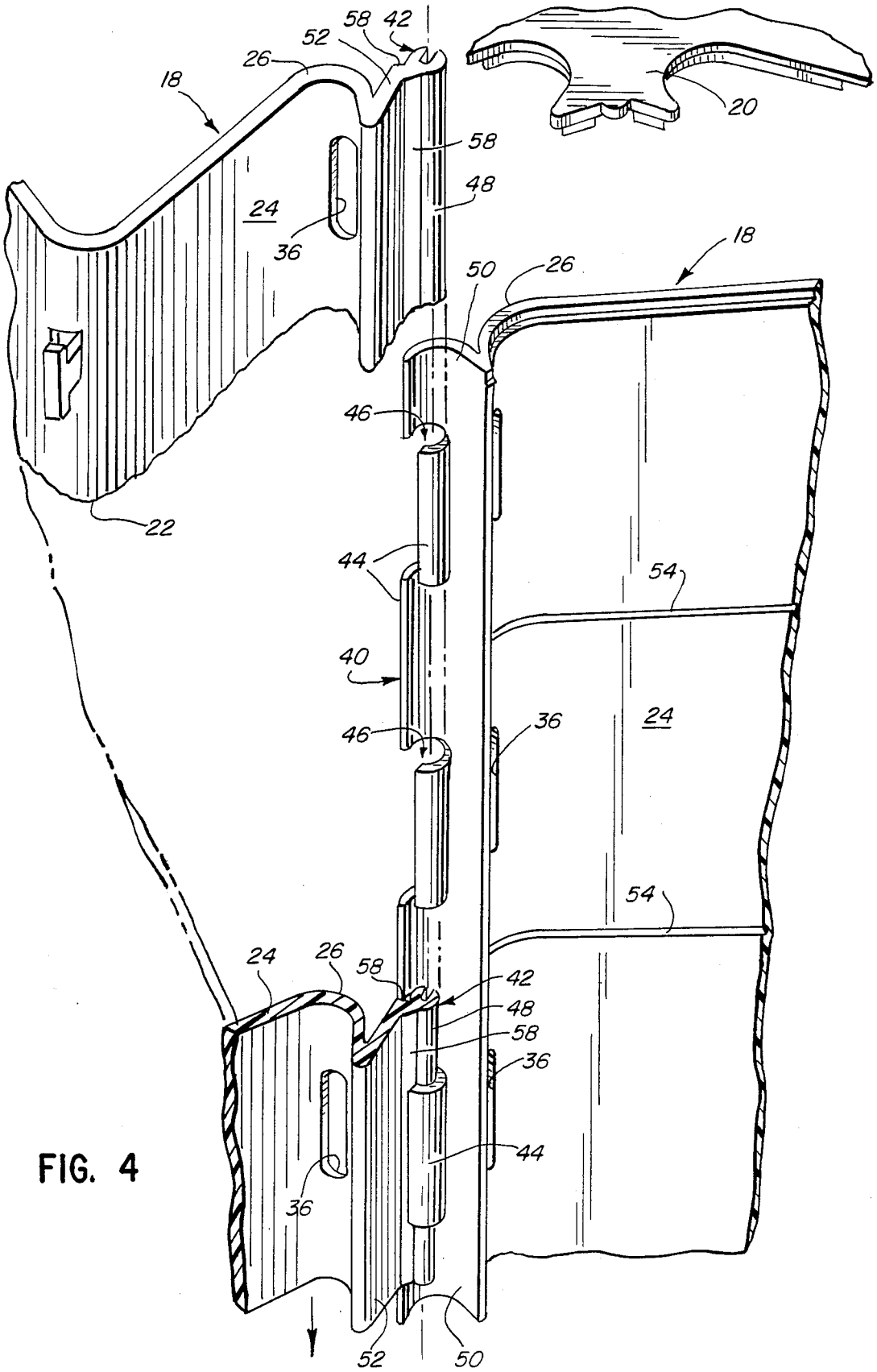
FIG. 4 is a fragmented perspective view illustrating the hinge means between adjacent modules.

Referring to FIGS. 3 and 4, in conjunction with FIGS. 1 and 2, each upright module 18 includes female hinge means, generally designated 40, along one edge thereof and male hinge means, generally designated 42, along the opposite edge thereof for mating with adjacent female hinge means 40 of an adjacent module.

As best seen in FIGS. 3 and 4, female hinge means 40 is defined by alternating, opposite curved sections 44 defining a continuous cylindrical path 46 extending vertically between the curved sections 44 from top-to-bottom of each upright module 18.

Male hinge means 42 is formed by a substantially cylindrical rib 48 which extends continuously from top-to-bottom of each upright module along the edge thereof opposite female hinge means 40 for mating with the female hinge means of an adjacent module.

Adjacent modules are assembled by simply sliding cylindrical rib 48 of one module axially into and through the cylindrical path 46 formed between sections 44 of the female hinge means 40 of an adjacent module, starting at one end thereof. It can be seen most clearly in FIGS. 2 and 4 that female and male hinge means 40 and 42, respectively, are molded integrally along distal edges of rearwardly projecting flat portions 50 and 52, respectively, so that the hinge means are somewhat recessed rearwardly as seen best in FIG. 1. Of course, this configuration is easily afforded by molding the upright modules.

It should be noted at this point that vertically spaced, horizontal lines 54 shown on each module 18 simply are slightly indented surfaces to sort of divide the modules in vertical sections for each eyeglass frame simply for visual convenience.

Lastly, a further feature of the invention is the provision of stop means to prevent excessive pivoting movement between adjacent upright modules 18 about hinge means 40,42. This provides for more easy assembly and prevents adjacent modules from "flopping" back and forth during assembly. The stop means is shown best in FIG. 3 wherein it can be seen that the distal edges 56 of female hinge sections 44 will abut shoulders 58 on opposite sides of male hinge rib 48 to limit relative rotation between adjacent modules in the direction of double-headed arrow 60.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A display assembly for eyeglass frames, each frame having a bridge and spaced temples, comprising a plurality of upright modules arranged edge-to-edge to define a multi-sided geometrical configuration, each module including:

a forwardly projecting mid-portion defining a vertical front face, a plurality of vertically spaced support means projecting forwardly of said front face and each serving as a cradle for the bridge of an eyeglass frame, horizontally spaced side portions extending rearwardly of the vertical front face, vertically extending concave edge portions at the rear of the side portions, the concave edge portions curving forwardly to define a hooked configuration, and spaced apertures at the base of each concave edge portion through which the temples can be extended, with the concave hooked configurations of the edge portions serving to guide the temples into the apertures and prevent the temples from sliding past the edges.

2. The display assembly of claim 1 wherein said forwardly facing mid-portion is convex in configuration, with the front face defined thereby merging smoothly into said side portions.

3. The display assembly of claim 2 wherein said rearwardly extending side portions are generally planar and merge smoothly into said concave edge portions.

4. The display assembly of claim 3 wherein said side portions diverge rearwardly from the front face.

5. The display assembly of claim 1 wherein said vertically spaced support means comprise a plurality of upwardly opening hooks for cradling the bridges of eyeglass frames.

6. The display assembly of claim 5 wherein said upwardly opening hooks each include a downwardly opening hook portion for receiving retaining means to hold an eyeglass frame on the hook.

7. In combination with the display assembly of claim 6, a plurality of elastic bands for embracing said downwardly opening hook portions and the eyeglass frames for holding the frames on the upwardly opening hooks.

8. A display assembly for eyeglass frames, each frame having a bridge and spaced temples, comprising a plurality of upright modules arranged edge-to-edge to define a multi-sided geometrical configuration, each module including:

a plurality of vertically spaced support means projecting forwardly of said front face and each serving as a cradle for the bridge of an eyeglass frame, generally planar side portions merging smoothly with the front face and extending rearwardly therefrom, vertically extending generally concave edge portions at the rear of the side portions and merging smoothly therewith, the concave edge portions curving forwardly to define a hooked configuration, and means on the edge portions for supporting the temples of the eyeglasses, with the concave hooked configurations of the edge portions serving to guide the temples into the supporting means and prevent the temples from sliding past the edges.

9. The display assembly of claim 8 wherein said side portions diverge rearwardly from the front face.

10. The display assembly of claim 9 wherein each module comprises a unitary molded structure.

* * * * *